US009505103B2

(12) United States Patent
Nguyen

(10) Patent No.: US 9,505,103 B2
(45) Date of Patent: Nov. 29, 2016

(54) CONTAINMENT HOUSING FOR AIRBLASTING PIPES AND SIMILAR OBJECTS

(71) Applicant: Phuong Taylor Nguyen, Richmod, TX (US)

(72) Inventor: Phuong Taylor Nguyen, Richmod, TX (US)

( * ) Notice: Subject to any disclaimer, the term of this patent is extended or adjusted under 35 U.S.C. 154(b) by 0 days.

(21) Appl. No.: 14/177,223

(22) Filed: Feb. 11, 2014

(65) Prior Publication Data

US 2016/0144479 A1 May 26, 2016

(51) Int. Cl.
*B24C 3/04* (2006.01)
*B24C 3/06* (2006.01)
*B24C 9/00* (2006.01)

(52) U.S. Cl.
CPC ..... *B24C 9/003* (2013.01)

(58) Field of Classification Search
CPC ..... B24C 3/065; B24C 3/06; B24C 3/04; B24C 9/00
USPC ..... 451/75, 87, 88, 38–40, 451, 456
See application file for complete search history.

(56) References Cited

U.S. PATENT DOCUMENTS 2,621,446 A * 12/1952 Russell ..... B24C 3/12 451/101
5,038,527 A * 8/1991 Fastje ..... B24C 3/062 451/456
5,267,417 A * 12/1993 Rose ..... B24C 1/086 451/38
8,827,770 B2 * 9/2014 Kuhlman ..... B24C 3/06 451/38
2011/0117823 A1 * 5/2011 Lynn ..... B24C 3/02 451/75

* cited by examiner

*Primary Examiner* — Robert Rose

(57) ABSTRACT

A containment system the operator to contain, see, blast, and reclaim the grit or abrasives used to strip external surfaces of a pipe, rod, or substantially cylindrical object. The containment chamber or housing is constructed of sections that can be quickly assembled to encapsulate such objects. The grit reclamation or recovery system of the invention is operable to be used in connection with objects that are positioned in a vertical, horizontal, or angled orientation. The containment housing is assembled from sections to encapsulate pipe to contain the dust and grit while blasting. The containment housing has inflatable seals that seal and grip around the pipe. Nozzle control and access as well as vision access are provided to allow the operator to control where the pipe will be blasted and the intensity of the blast. The containment system has a centrifugal grit reclamation design that will work in vertical, horizontal and angular orientation.

2 Claims, 10 Drawing Sheets

CONTAINMENT HOUSING FOR AIRBLASTING PIPES AND SIMILAR OBJECTS

BACKGROUND OF THE INVENTION

Field of the Invention

The invention is generally related to airblasting various objects and is specifically directed to a containment system for airblasting pipes and similar objects while containing the blasted portion in a confined and closed chamber.

Discussion of the Prior Art

It is known in the art to apply or propel various substances, materials and/or media, both abrasive and non-abrasive, against a desired surface in order to treat the surface, e.g., polish, clean, abrade, prepare a surface for painting, remove rust, grease or oil and the like. The blasting media may consist of dry or liquid material or a combination thereof with or without a variety of abrasive or non-abrasive constituents added thereto. In many applications, the blasting media is a composite media comprising a combination of two or more components which are mixed or blended together with one another, in the desired proportion, to achieve the desired surface treatment. Application of the blasting media by means of a pressurized applicator generally results in a substantial quantity of media and contaminants becoming airborne and rebounding off of the surface being treated.

The state of the art for blasting external surfaces of pipes, rods and similar objects is to "open blast". This is airblast in an open environment. This process creates many issues. First, the grit and dust are allowed into the open where they will be carried with the wind or fall onto the ground. If the paint or surface contains hazardous material, this may result in air or ground pollution or contamination. Also, the operator must wear protective equipment such as respirator for the dust and protective clothing to withstand the impact from rebounded grit or abrasives.

It is desirable that this rebounding media be adequately contained within an enclosed treatment area in order to prevent contamination to the surrounding environment with the media and/or removed contaminants and/or debris from the surface being treated. This is especially true if hazardous materials are being removed from the surface being treated. In order to protect the operator it is known to have contained nozzles that are automated and mechanized to blast exterior surfaces of pipe. It is also known to use handheld blast and vacuum heads to blast and treat the exterior surface of the object being treated. Such mechanized systems are generally heavier, very expensive, and slower to setup. The handheld blast and vacuum heads also generally have slow production and the nozzle is at a relatively fixed orientation. Also, handheld heads require exertion from the operator to maintain a seal while blasting. This makes them subject to operator error and subject to familiarity and experience. Neither of the aforementioned systems allows vision so the blaster (operator) is blind to the activity or progress. Vision is desired, if not required, in situations where the operator requires precise control of the area to be blasted.

There are also containment systems currently known in the art are which are used in the treatment of such objects. These systems contain the blasting media and other material, contaminant, debris and hazardous material in order to suppress the harmful effects to a confined area. However, to treat these objects or surfaces, generally an operator would be required to be inside the containment area and thus subjected to such hazardous conditions and do not eliminate the need for the operator to wear protective clothing and use protected, filtered breathing apparatus. These type of containment systems are relatively large and require much labor to set up.

U.S. Pat. No. 8,556,683 discloses a containment barrier for containing a blasting media during treatment of such objects, the containment barrier being defined by a peripheral housing having three or more body surfaces and two end surfaces, defining an enclosed treatment area. A viewing aperture is located within a first body surface, with a transparent member being placed within the viewing aperture to contain blasting media within the enclosed treatment area while enabling observation of the object being treated. An elongate access aperture is located within one of the body surfaces, and an elongate cylindrical access port body is rotatably fixed within the access aperture to allow restricted access to the enclosed treatment area for enabling insertion of one or more tools used during the treatment the object. The access port body has an elongate tool inlet and an opposed elongate tool outlet. The interior of the access port body includes a tool retainer slidable along the elongate port body for allowing directed treatment of the object along a first axis. The port body is rotatably fixed at opposed ends for enabling axial rotation of the port body allowing directed treatment of the object in a second axis. The tool inlet is substantially enclosed by a seal. A media evacuation system including one or more exhaust hoses is used to evacuate the spent media.

SUMMARY OF THE INVENTION

The containment system of the subject invention permits the operator to contain, see, blast, and reclaim the grit or abrasives used to strip external surfaces of a pipe, rod, or substantially cylindrical object. The containment chamber or housing is constructed of sections that can be quickly assembled to encapsulate such objects for airblast, treating, cleaning or stripping the external surfaces of the object or the portion thereof which is housed inside the containment chamber. The system will permit the operator to blast an object that is vertical, horizontal, or at an angle. The grit reclamation or recovery system of the invention is operable to be used in connection with objects that are positioned in a vertical, horizontal, or angled orientation. The containment housing is assembled from sections to encapsulate pipe to contain the dust and grit while blasting. The containment housing has inflatable seals that seal and grip around the pipe. Nozzle control and access as well as vision access are provided to allow the operator to control where the pipe will be blasted and the intensity of the blast. The containment system has a centrifugal grit reclamation design that will work in vertical, horizontal and angular orientation.

The system of the invention is adapted to be used in connection an airblast system, which is well known by those of ordinary skill in the art, for grit blasting the object surface. A companion or integral vacuum system is used to reclaim the dust and grit. In addition, the vacuum system will complement the containment housing by maintaining the treatment chamber under vacuum pressure. In essence, the airblast system in a module adapted to be placed in one or more ports I the containment housing, to blast and to visually inspect the object being treated.

The visual component includes a viewing device such as a lens, or a camera for transmitting the view to a remote location and for recording. A purge system is in communication with the lens or camera for maintaining an unobstructed view during operation.

The containment system of the subject invention includes a chamber housing which is made of two sections. This permits the system to be assembled around an object without inserting the object ends into the chamber through a port. The sections are clamped together around the object without having to disturb the location or mounting of the object.

During operation the vision port is constantly purged to enhance viewing and to protect the vision panel or lens. By utilizing a purged vision panel, it is possible to employ a camera through the port without damaging the camera lens during operation.

The chamber housing interior is sealed around the object by deployable seals. In the preferred embodiment normally deflated inflatable composite seals are used to seal and grip circumferentially around the OD of the object at each end of the containment chamber.

The vacuum exhaust system utilizes an induced helical airflow to transport the dust, grit and other loose contaminant particles to an outlet port provided in the containment chamber. This induced centrifugal motion entrains the particles within the containment chamber and uses centripetal force to keep the particles flowing against the internal diameter of the containment housing until it is pulled into the vacuum outlet port, from which they flow into a reclamation system. Preferably, the pressurized delivery nozzle system can be used to blast clean air for purging the chamber when desired.

DETAILED DESCRIPTION

Figure 1:
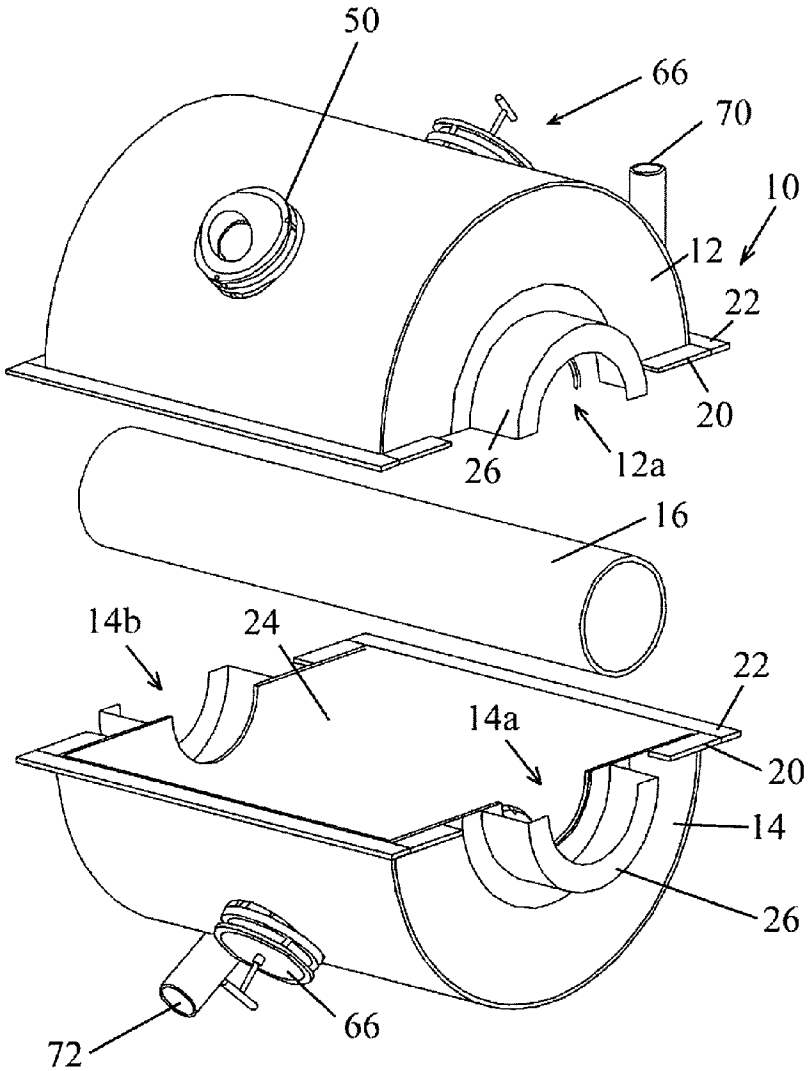
FIG. 1 is a perspective view of the containment system of the subject invention, with the two sections separated and ready for installation around a pipe or similar object.
Figure 2:
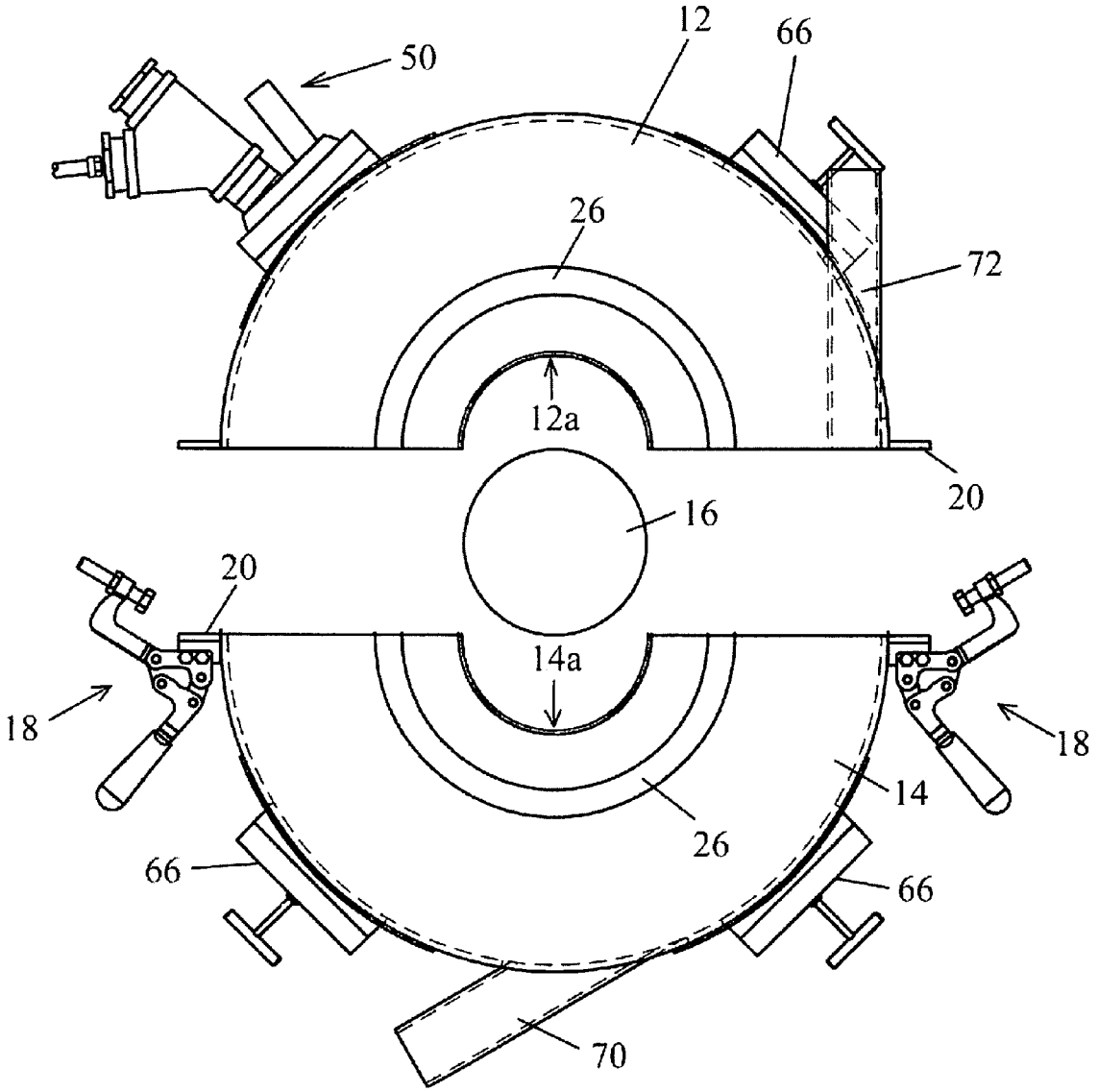
FIG. 2 is an end view of the system of FIG. 1, showing the clamping system and operating components.
Figure 3:
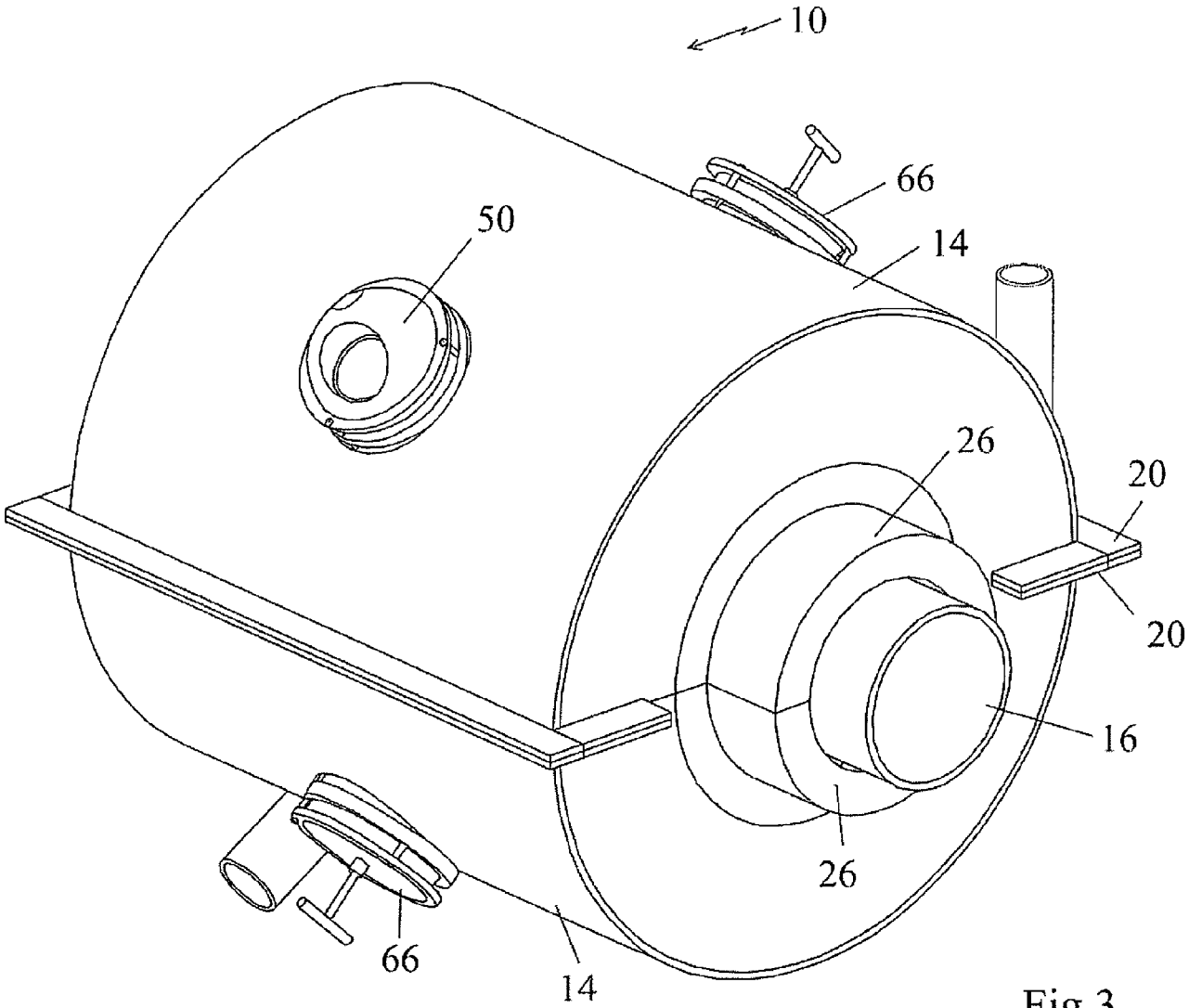
FIG. 3 is a perspective view looking in the same direction as FIG. 1, with the two sections closed around the object to defining a blasting chamber.
Figure 4:
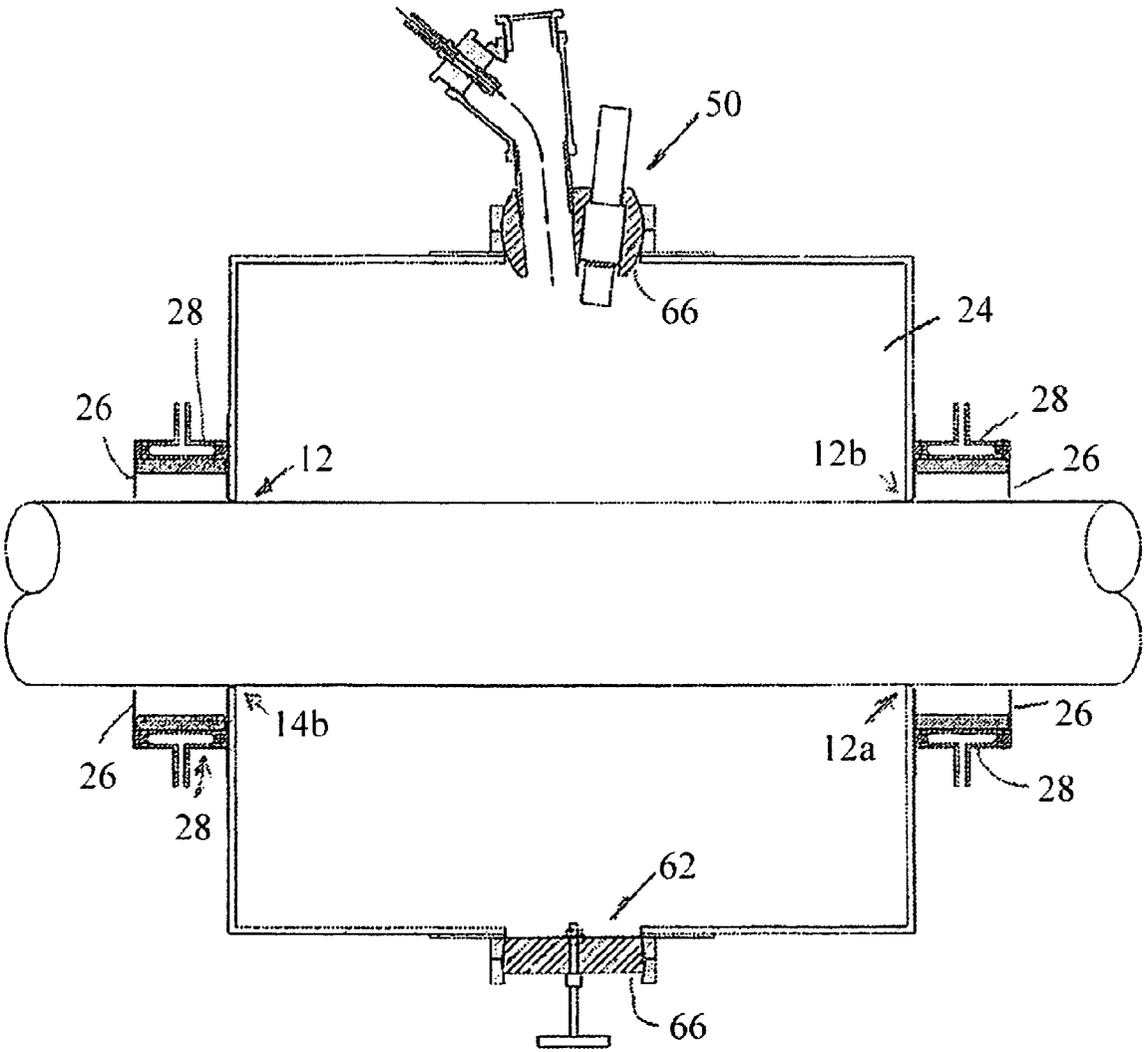
FIG. 4 is a sectional view showing the two sections closed around the pipe, before the port seals are closed but in the open position.

As best shown in FIGS. 1 and 2, the containment housing 10, is formed of two sections 12 and 14. This permits the housing to be placed around the object to be treated, such as the pipe 16. Body clamps 18 hold the housing together, see FIG. 2. A seal flange 20 is provided on each section 12 and 14. A suitable replaceable seal 22 may be placed on one or both flanges to provide a peripheral seal when the containment housing is assembled, as shown in FIG. 3. Each section 12 and 14 of the housing includes a pair of axially aligned access holes, 12*a* and 12*b*, and 14*a* and 14*b*, respectively (see also FIG. 4). The access holes 12*a*, 12*b*, 14*a* and 14*b* are configured to accept and cradle the pipe 16 when the two sections 12 and 14 are assembled to form the containment housing 10 and the internal operating chamber 24 (FIG. 4).

Figure 5:
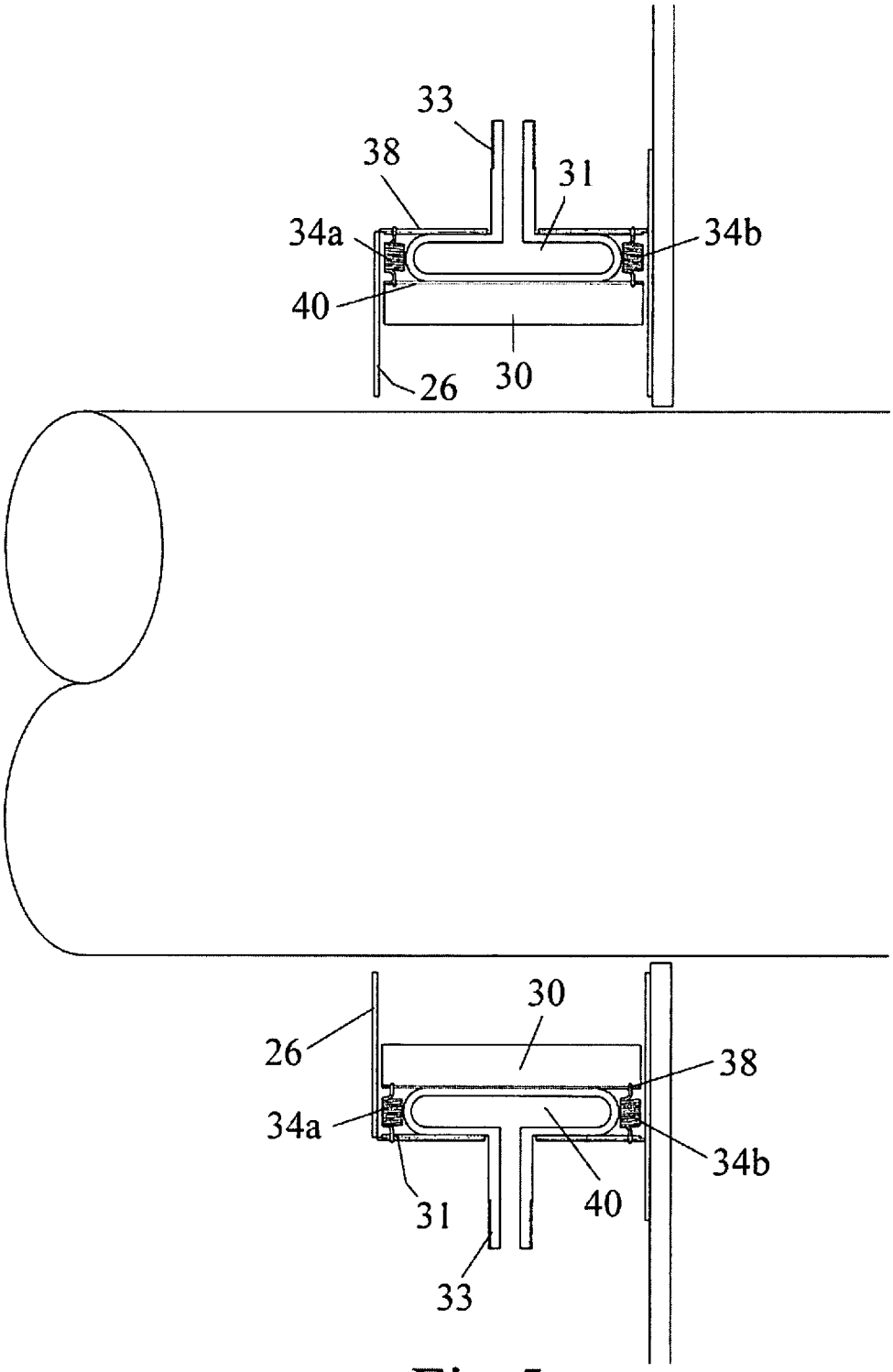
FIG. 5 is an enlarged view similar to FIG. 4, showing the port seals in more detail.
Figure 6:
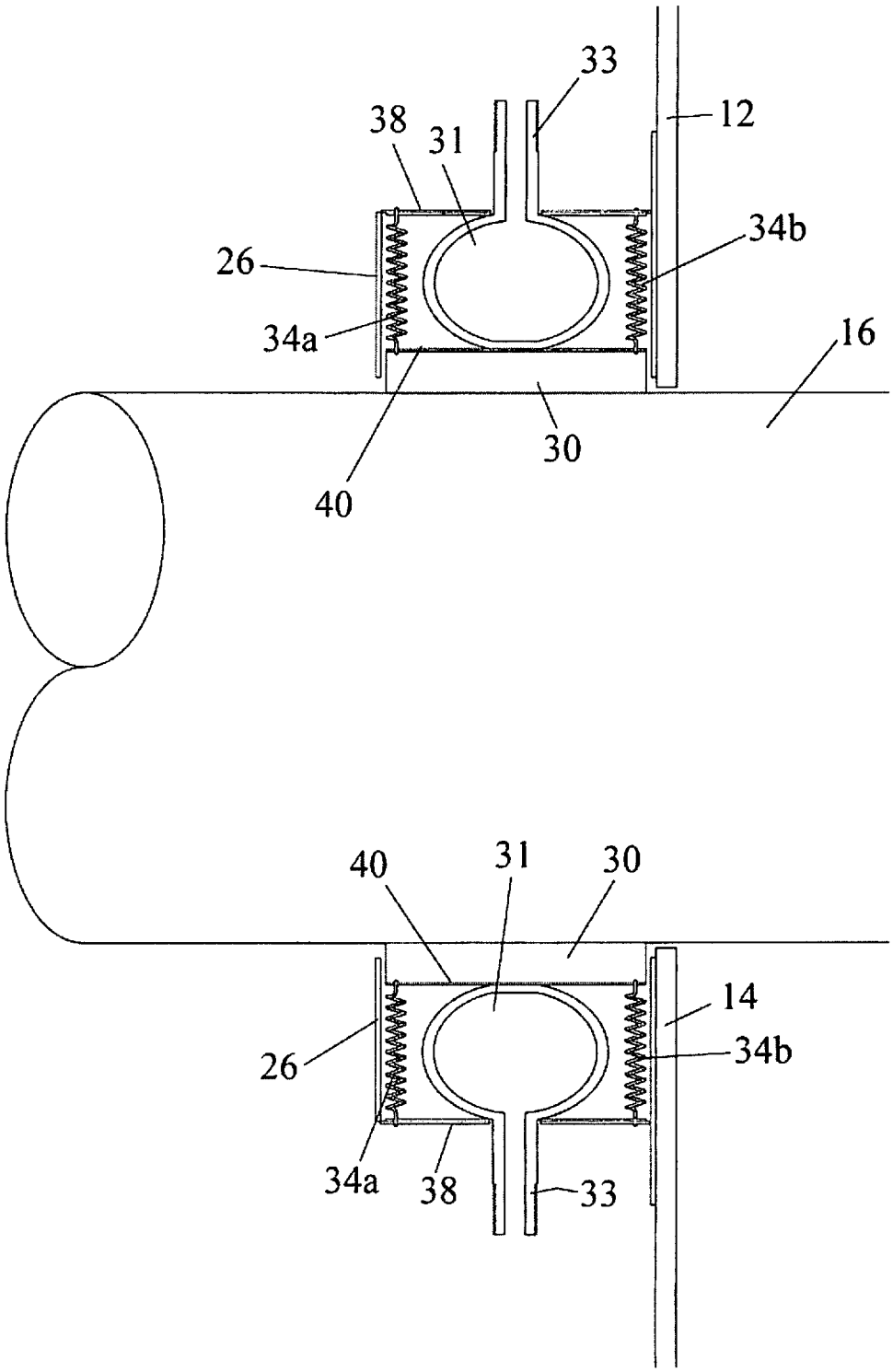
FIG. 6 is a view similar to FIG. 4, showing the port seals closed for forming a closed chamber housing the section of the object which is to be treated.

Each of the access hole components 12*a*, 12*b*, 14*a* and 14*b* includes a seal housing or seal shroud 26. A retractable or collapsible seal 28 is seated in each shroud (See FIG. 4). In the preferred embodiment normally open inflatable composite seal elements 30 are used to seal and grip circumferentially around the OD of pipe at each end of the containment (See FIGS. 5 and 6). Each of the seals includes an inflatable bladder 31 which is connected to a suitable source of regulated pressurized air at stem 33 to inflate and deflate the seal. The grip of the inflatable composite seal can be adjusted to adequately support the pipe 16 in a horizontal, vertical or angled position. The grip force applied on the pipe is proportional to the compressed air pressure supplied which can be controlled by a compressed air regulator.

Each half side of the composite seal assembly 28 is housed in a shroud or housing 26, and comprises the inflatable bladder 301, the tension springs 34*a* and 34*b*, and the pipe engaging sealing member 32. The shroud 26 protects the components inside of it and provides a surface 36 for the inflatable bladder to push against.

The outer inflatable backing ring 38 is fastened to the shroud 26 to act as an anchor surface for the springs. The shroud is fastened onto each flat of the containment body. This allows the user to change the composite seal assembly to match with the outside diameter of the pipe. Quick fasteners or other suitable fastener systems may be used to secure the seal assembly 28 in the shroud 26. The inflatable bladder 31 allows the operator to use regulated compressed air to expand the bladder and ultimately push the pipe sealing element 30 against the pipe OD.

Each peripheral pipe seal assembly, one at each end of the containment housing, comprises two halves, one on section 12 and the other on section 14 of the containment housing 10. Each includes the compressed air port or stem 33. The bladder 31 of each section is sandwiched between the outer ring 38 and an inner ring 40. The tension springs 34*a* and 34*b* connect the inner ring 40 and outer ring 38. When not inflated the tension springs pull the inner ring 40 towards the anchored outer ring 38 to pull the seal away from the pipe surface.

Preferably, the outer ring 38 is cylindrical and thin enough to have some flexibility to accommodate easy concentric installation inside of the housing 26. It is formed to fit just inside the housing. The outer ring is fastened or anchored to the housing. One end of each tension spring is attached to the outer ring. The inner inflatable backing ring 40 is cylindrical and is thin enough to have sufficient flexibility to fit concentrically between the inflatable bladder 31 and the pipe sealing element 32. The other end of each tension spring is attached to inner ring 38. The pipe sealing element is attached to the ID of the inner ring by a suitable adhesive or other means.

The expandable tension springs 34*a* and 34*b* are arranged evenly along the backing rings 38 and 40. They are configured to have slight tension in the relaxed or open state. This assures the pipe seal is pulled away from the pipe OD once air pressure is removed from the bladder. The inflation and deflation of the bladder may be controlled with valves mounted on the containment body.

The pipe seal is a made of a soft and pliable material, such as, by way of example, a sponge neoprene. Any solid soft material, including but not limited to rubber or urethane, may also be used depending upon the smoothness of the pipe exterior. The pipe sealing element is attached to the pipe seal backing ring 40. Inflating the bladder 31 will force the backing ring 40 to push the pipe seal 32 against the OD of the pipe 16, thereby creating grip and tight seal. The friction force of the grip and the sturdiness of the housing are a matter of choice but are intended to be sufficient for the containment to support itself.

Figure 7:
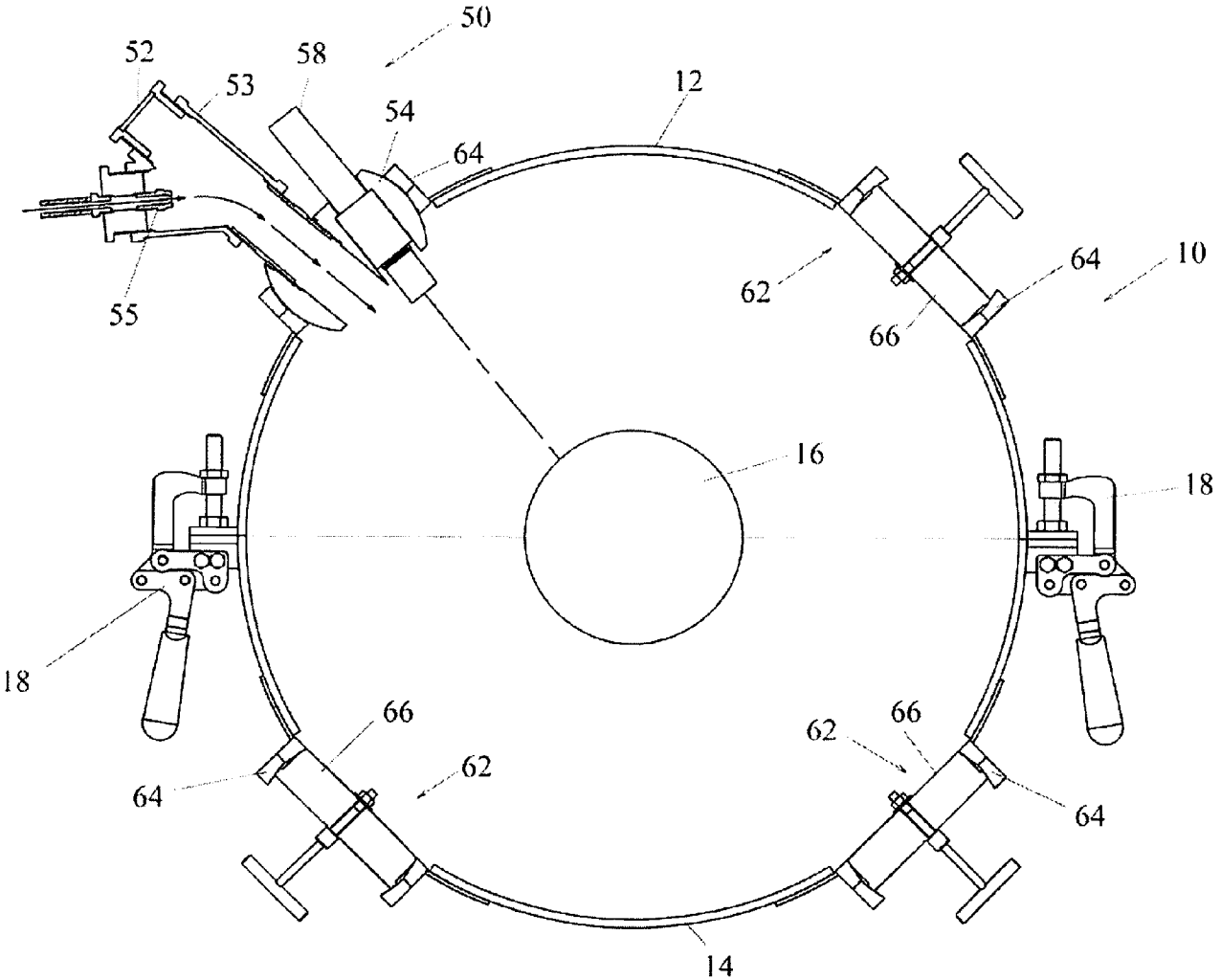
FIG. 7 is a section view showing the closed chamber, clamps, operating ports for the media delivery system.

In the preferred embodiment there are a plurality of access ports 62 angularly spaced about the outer circumference of the containment housing 10 (See FIGS. 2, 3 and 7). Each port 62 includes a mounting ring 64. When not in use a plug or blank 66 is removably locked in the port 62 to seal it closed. In one of the ports an airblast module 50 is mounted in the ring 64. The airblast component 50 includes a swivel ring 54, permitting directional control of the blast stream during operation. Nozzle 58 is suitable attached to a source system for providing pressurized air and media mixtures for airblast cleaning the pipe or similar object 16. In the home position the blast nozzle is directed toward the center of the pipe 16. A lens or other vision panel 52 is provided in a tube 53 which is carried in the airblast module 50. This permits viewing and observation of the work during operation. The vision panel may be a lens or, where desired, a transmitter such as a camera, for remote viewing and recording. In order to maintain a clean lens a pressurized clean air or air only purge line 55 is provided to create a positive pressure barrier to reduce or eliminate stray debris and media from interfering with or blocking the lens panel 52.

The vision panel system utilizes compressed air to continuously purge and protect the vision lens or panel 52. Prior art vision panels have had two unresolved issues. First, the vision panel accumulates dust emitted within the containment created by the airblast activity. Second, the rebounded larger particles would strike and scratch and/or dent the inside surface. Both of which progressively reduce visibility. Compressed air provides a more satisfactory solution that is capable of generating sufficient air velocities to minimize both problems. Resolving the rebounded particles solved both problems since this was the more demanding concern. This design also protects small video cameras (surveillance camera with image on small monitors). These cameras can be mounted in the lens port. The vision port centerline 60 is calibrated to intersect the nozzle centerline at the average distance of the pipe exterior to the nozzle. This enables the operator to see the current area being blasted.

Figure 8:
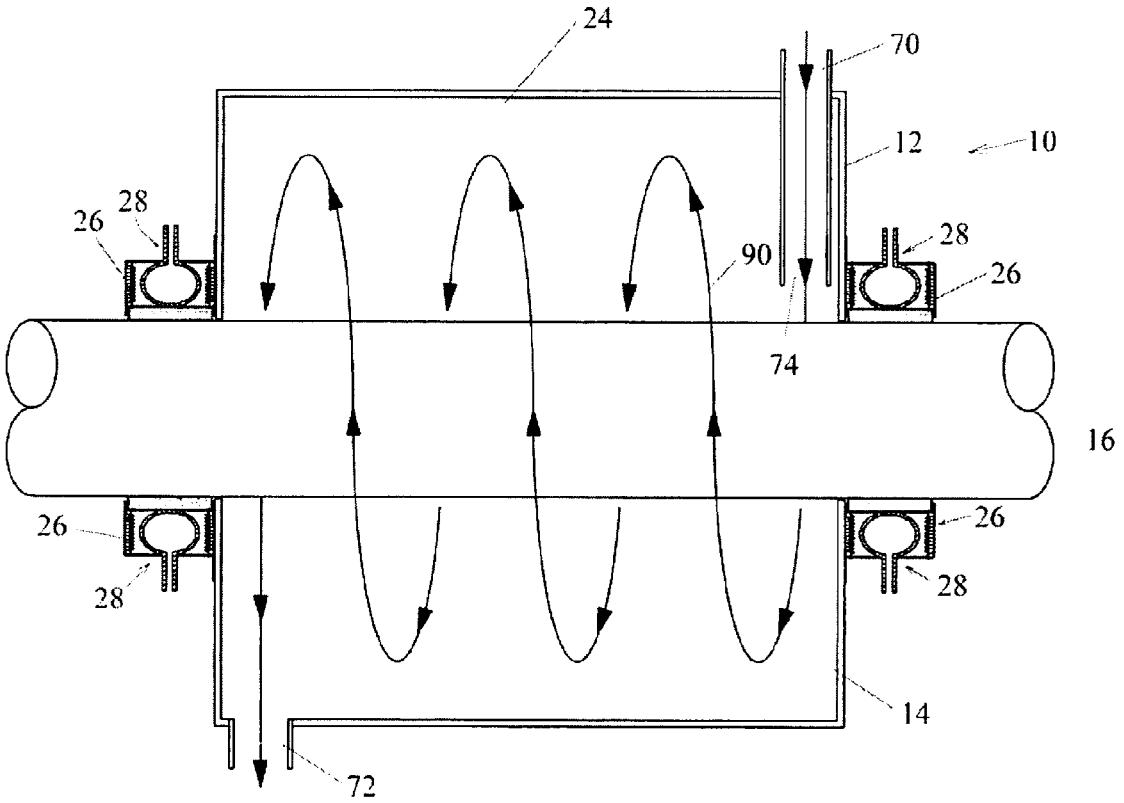
FIG. 8 is similar to FIG. 7 and shows the flow control and vacuum evacuation and purge system.

The blast and containment system of the subject invention includes a centrifugal reclamation system that utilizes induced helical airflow to transport the dust and grit to the vacuum outlet port. This is best illustrated in FIG. 8. The induced centrifugal motion of the airflow introduced at port 70 entrains the particles within the containment and uses centripetal force to keep the particles flowing against the internal diameter of containment body until it is thrown and pulled into the vacuum out port 72. From the vacuum port, the particles flow into a typical reclaim system equipped with a vacuum source. The reclamation may be processed for reuse or may be collected for disposal.

In order to maintain dust containment, the vacuum flow, negative gage pressure, must be greater than the sum of all compressed air flow within the containment (blast nozzle, vision purge, and purge assist). This embodiment of the centrifugal reclaim consists of the vacuum inlet 70 that is configured where the entry is tangential with the ID of the containment body 10. This configuration will predispose the air to flow along the ID of the containment in a helical or cyclonic pattern, as illustrated by the arrows 90, until it exits through the vacuum outlet 72. The illustrated design incorporates round ports but a square or rectangular port may also be used.

The vacuum inlet protrudes inside the containment, as shown at 74, with a square cut so that it will minimize its projected exposed area to blasting rebound. The blast nozzle air introduced through one of the ports 62 (See FIG. 7) can be used to complement the cyclonic flow with the containment. During blasting the nozzle blast air can complement or counteract the designed rotation of the air flow depending upon which side of the pipe's longitudinal axis is being blasted It is desirable that the blast equipment is equipped with an abrasive cutoff feature which allows the operator to cutoff the abrasive and allow only compressed air through the blast nozzle. This feature would permit the operator to aim the nozzle within the containment such that the resulting flow pushes and complement the vacuum flow. This step will assist in purging the containment chamber as an intermediate step during blasting or after blasting.

The vacuum outlet 72 is also placed tangential to the ID of the containment body such that the designed cyclonic flow directs the dust and grit into this port. This port is contoured with the ID of the containment in order to maximize the exposed area of the vacuum port to the interior of the containment. The vacuum generator and reclamation system is connected to the port 72. This port is round as shown, but a square or rectangular port could also be used and in some cases may be more effective at completely evacuating the containment. In the vertical configuration of the containment, the vacuum out port 72 is orientated at the lowest point using gravity to collect the grit at the bottom. The cyclonic flow spins the grit and abrasive at the bottom until it is entrained into the vacuum outlet.

When the containment is in the angled position, the vacuum outlet is oriented at the lowest position such that the containment body cylinder and flat end together act as a trough or funnel utilizing gravity to pull the grit towards the vacuum outlet.

In the horizontal position, FIG. 8 shows the vacuum out port 72 in the optimum arrangement for the horizontal position. Increasing the vacuum induced flow will increase the effectiveness of the reclaim. Regardless, introducing the blast nozzle air in the proper rotation will adequately entrain residual particles to eventually purge the interior of the containment.

A compressed air cyclonic assist nozzle may be used to complement the cyclonic vacuum flow. This may be accomplished by inserting a small pressure nozzle (not shown) inside of the vacuum inlet port 70 to complement the cyclonic vacuum flow. The blast nozzle compressed air assist has been shown to assist the vacuum air system to entrain and remove the residual grit and dust.

Figure 9:
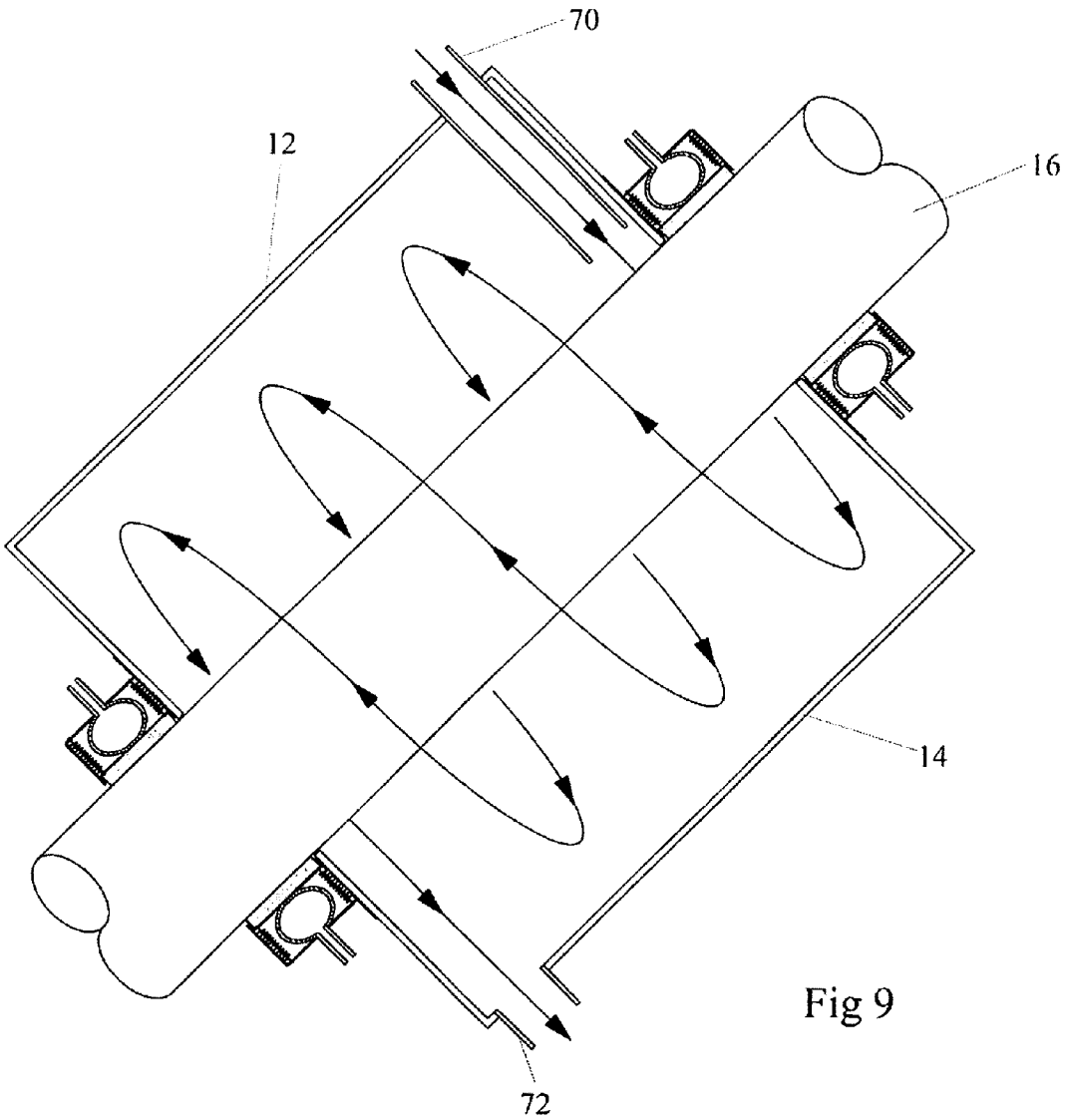
FIG. 9 shows the system as used in an angled application.

FIG. 9 shows the system as used in an angled application.

Figure 10:
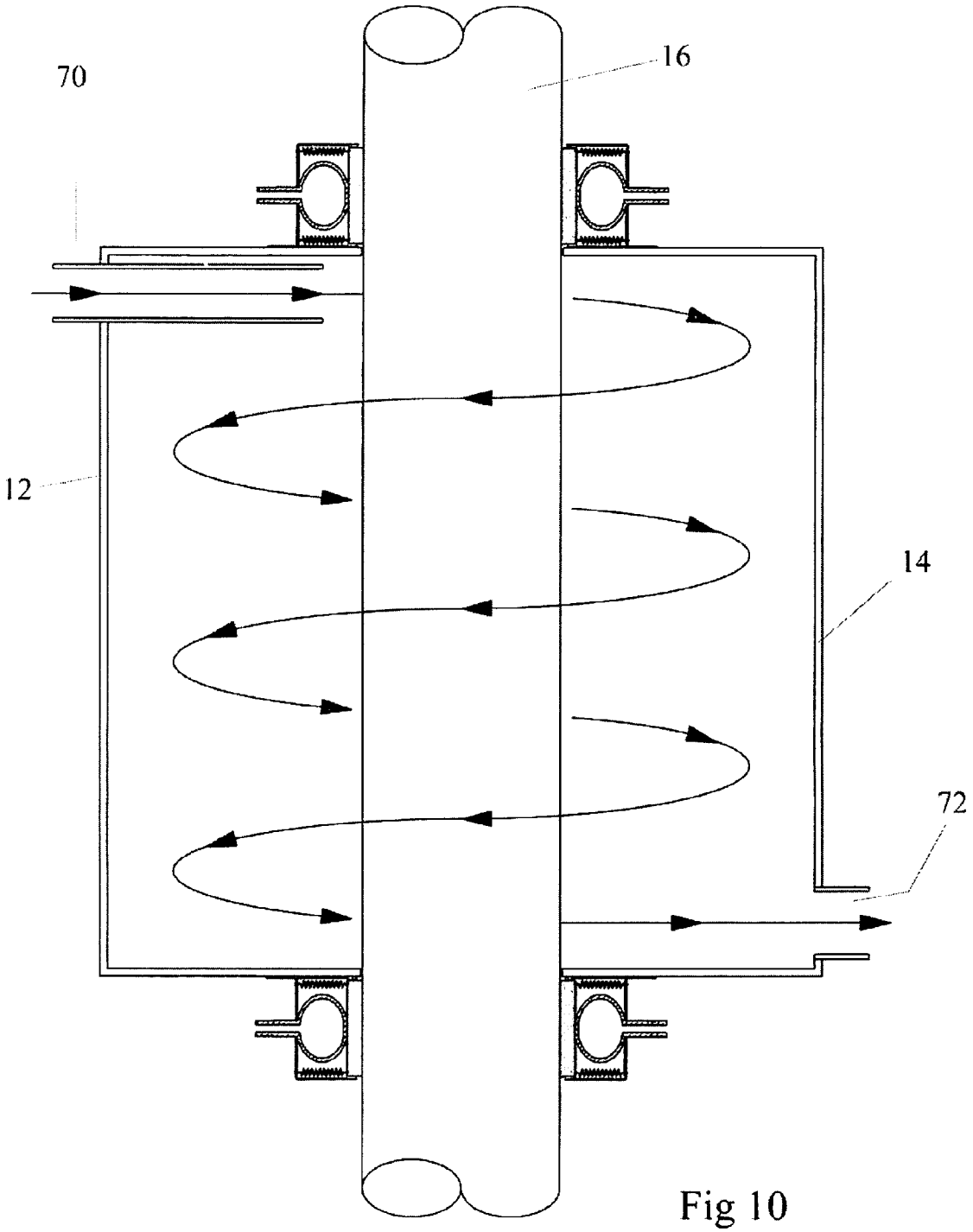
FIG. 10 shows the system as used in a vertical application.

FIG. 10 shows the system as used in a vertical application.

While certain features and embodiments of the invention have been described in detail herein, it should be understood that the invention encompasses all modifications and enhancements within the scope and spirit of the following claims.

What is claimed is:

1. A containment system for containing a pipe or similar object during airblasting, the containment system having a first section and a second section adapted to be placed in an assembled, mated relationship for defining a generally cylindrical chamber for housing and supporting a portion of a pipe or similar object during airblasting, the containment system comprising:

a. Pipe receptive ports in each end of the assembled chamber;

b. Engageable and disengageable seals in each of the ports for holding the pipe and sealing the ports around the pipe to seal the chamber;

c. Each of the seals comprising:

i. a pipe engaging seal;

ii. an expandable bladder in communication with the pipe engaging seal for engaging and releasing the pipe engaging seal;

iii. a spring attached to the pipe engaging seal for urging the pipe engaging seal into a released position when not secured in the pipe engaging position by the bladder when the bladder is expanded.

2. A closed, substantially cylindrical pipe containment system for securing and containing a pipe during airblasting, the system comprising:

a. A circumferential wall defining the substantially cylindrical pipe containment system;

b. At least one access port in the circumferential wall of the system;

c. A plug for closing the access port when not in use;

d. An airblast module adapted to be placed in the access port during use, the airblast module comprising:

i. A blast nozzle;

ii. A sight port adjacent the nozzle, the sight port including a view window;

iii. A transparent cover over the view window; and iv. A purge line for directing pressurized clean air in the vicinity of the view window to minimize migration of stray debris and media into the view window and cover during airblasting operation.

* * * * *